United States Patent [19]

Rytting

[11] 4,069,998

[45] Jan. 24, 1978

[54] PICTURE HANGER

[76] Inventor: James R. Rytting, 3575 S. 20 East, Salt Lake City, Utah 84109

[21] Appl. No.: 735,424

[22] Filed: Oct. 26, 1976

[51] Int. Cl.[2] ..... A47G 1/24

[52] U.S. Cl. ..... 248/476; 248/225.2

[58] Field of Search ..... 248/225.2, 467, 475 R, 248/476, 489, 497, 498, 495, 496

[56] References Cited

U.S. PATENT DOCUMENTS

| | | | |
|---|---|---|---|
| 2,965,339 | 12/1960 | Denton | 248/495 |
| 3,254,438 | 6/1966 | Filary et al. | 248/467 X |
| 3,612,469 | 10/1971 | Dennis | 248/475 R |
| 3,926,399 | 12/1975 | Tendler | 248/467 |

FOREIGN PATENT DOCUMENTS

| | | | |
|---|---|---|---|
| 593,348 | 10/1947 | United Kingdom | 248/498 |

*Primary Examiner*—William H. Schultz
*Attorney, Agent, or Firm*—B. Deon Criddle

[57] ABSTRACT

A picture hanger comprising mating components adapted to be respectively secured to a picture back, or the like, and to a wall or the like. The components include a support bar comprising a pair of end spacers, each with a flat upper surface and a flat connecting link interconnecting the end spacers and a hooking bar including a pair of end blocks with flat lower surfaces and interconnected by a flat, depending bar that will fit between the end spacers and flat connecting link of the support bar.

1 Claim, 3 Drawing Figures

PICTURE HANGER

BRIEF DESCRIPTION OF THE INVENTION

1. Field of the Invention

This invention relates to devices for use in hanging pictures, or the like on walls, or the like. It is particularly related to mating devices including one portion that mounts on the wall and another that mounts on the back of a picture or the like and wherein the parts are coupled together to hang the picture on the wall.

2. Prior Art

A great many arrangements have been proposed in the past to facilitate the hanging of a picture, or the like on a wall. Many of these arrangements have been makeshift, such as a nail or screw inserted in the wall to engage a portion of a picture frame, and others have utilized mating components, such as hooks and wires. Still others involve the use of gummed fabrics or other adhesive mountings that cannot be reused.

However, there has not been available, to my knowledge, a pair of interlocking components that can be easily positioned to provide level hung pictures and the like and that will provide for a measure of horizontal adjustability. Neither has there been such a picture hanger that can be reused.

Principal objects of the present invention are to provide a picture hanger that is easily positioned to provide for the level hanging of pictures, and that will permit horizontal adjustment and positioning of the hung picture.

Other objects are to provide a low cost picture hanger and one that can be readily reused.

Principal features of the invention include a support bar that has a pair of end spacers, interconnected by a connecting link having a flat inner surface from which the end spacers project. An upper surface of each of the end supports is made flat to cooperate with lower flat surfaces of a pair of end blocks of a hooking bar. The end blocks of the hooking bar are interconnected by a depending bar, having a flat surface arranged to fit against the flat inner surface of the connecting link and downwardly between the end spacers when the end blocks are in engagement with the end spacers.

Additional objects and features of the invention will become apparent from the following detailed description and drawings, disclosing what is presently contemplated as being the best mode of the invention.

THE DRAWINGS

In the drawings:

FIG. 1 is a perspective view of the hanger of the invention mounted on a wall, shown fragmentarily;

FIG. 2, a vertical section, taken on the line 2—2 of FIG. 1; and

FIG. 3, an enlarged perspective view, with the parts exploded for clarity.

DETAILED DESCRIPTION

Figure 1:
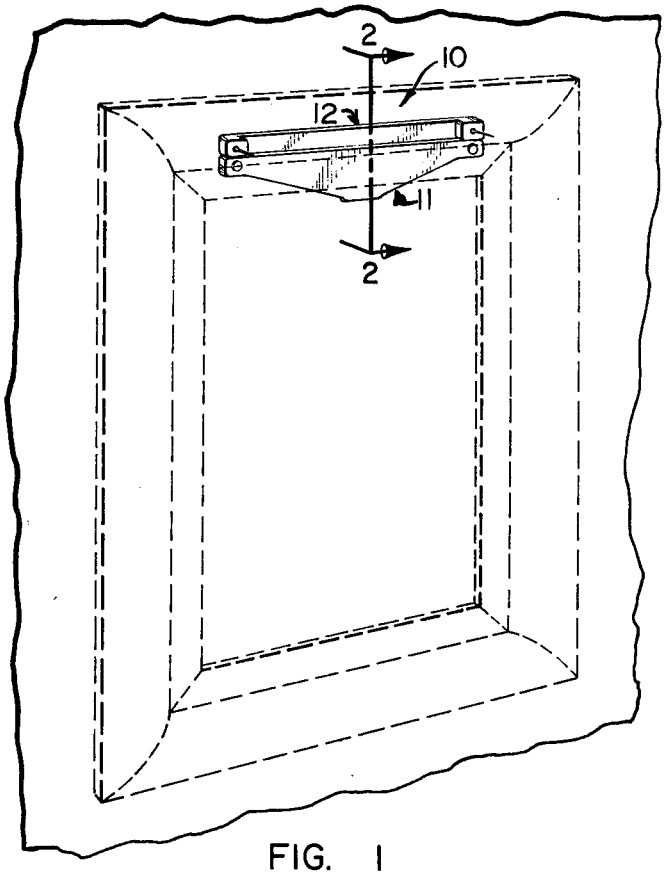
Figure 2:
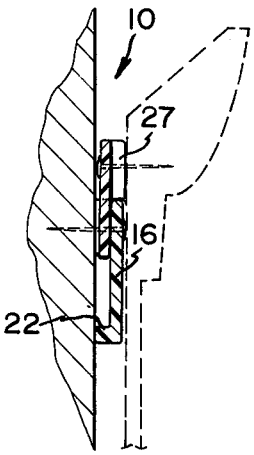
Figure 3:
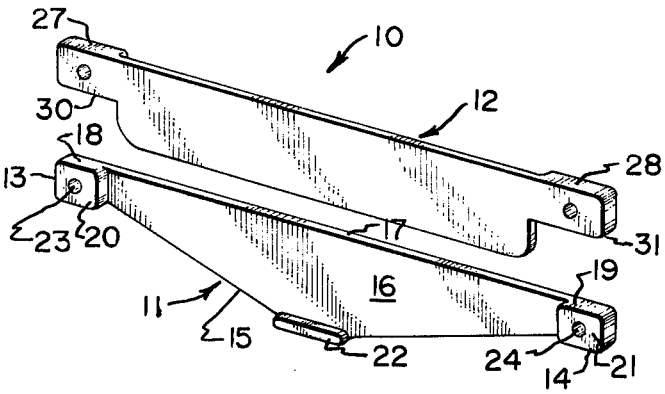

Referring now to the drawings:

In the illustrated preferred embodiment, the picture hanger of the invention, shown generally at 10 includes a support bar 11 and a hooking bar 12.

The support bar 11 includes a pair of end spacers 13 and 14 interconnected by a connecting link 15. The connecting link has a flat surface 16 that is between the end spacers and a straight edge 17 that is flush with flat upper surfaces 18 and 19 of the end spacers 13 and 14. The end spacers 13 and 14 respectively include flat surfaces 20 and 21 that are adapted to fit flush against a wall or the like and that project forwardly of the flat surface 16. Connecting link 15 has a block 22 affixed thereto to project from flat surface 16 and an outer wall engaging surface to be aligned with the flat surfaces 18 and 19. Holes 23 and 24 are provided through the end spacers 13 and 14 and nails 25 and 26, are inserted through the holes to secure the support bar to a wall or the like. The end spacers and block 22 then hold the connecting link a spaced distance from the wall.

The hooking bar 12 includes a pair of end blocks 27 and 28, interconnected by a flat, depending bar 29. The bar 29 is thin enough to fit between connecting link 15 and a wall to which the end spacers of the support bar is attached and extends downwardly below the end blocks to engage the flat surface 16 of the connecting link.

The end blocks 27 and 28 have flat, bottom surfaces 30 and 31 that are adapted to rest on the flat top surfaces 18 and 19 of end spacers 13 and 14 and to slide thereover. The length of the depending bar 29 between the end blocks 27 and 28 is less than the distance between end spacers 13 and 14 so that when the picture hanger is assembled, the hooking bar will slide horizontally with respect thereto. Holes 33 and 34, through the end blocks 27 and 28 receive nails 35 and 36 therethrough to secure the hooking bar to a picture or the like to be hung on a wall. The combined thickness of the flat connecting link and the flat depending bar is just slightly less than the thickness of either the end spacers or the end blocks, to provide maximum strength and easy coupling of the hooking end support bars.

In use, the support bar 11 is secured to a wall or the like at a desired height and is positioned such that the surfaces 18 and 19 are level.

The hooking bar 12 is attached to the back of a picture, mirror, or other such object to be hung on the wall, with the end spacers 27 and 28 against the object and the depending bar 29 spaced therefrom. The lower surfaces 30 and 31 of the end spacers are aligned with a portion of the object to be made horizontal, i.e. the top of a picture or mirror and the object is hung on the wall by inserting the depending bar between the wall and the attached support bar. Thereafter, the object can be moved horizontally, as desired and within the limits of travel allowed by engagement of the depending bar with the end spacers.

While a preferred embodiment of my invention has been herein disclosed, it is to be understood that such disclosure is by way of example and that variations are possible without departing from the subject matter of the following claims, which subject matter I regard as my invention.

I claim:

1. A picture support hanger comprising a support bar including a pair of end spacers, each with a flat upper surface and interconnected by a flat connecting link;

a hooking bar including a pair of end blocks, each having a flat lower surface to mate with the flat upper surfaces of the end spacers, and a flat depending bar interconnecting the end blocks and projecting downwardly below the end blocks to be between the end spacers, the combined thickness of the flat connecting link and flat depending bar being slightly less than the thickness of either the end spacers or the end blocks; and the length of the flat depending bar being such that it is movable between the end spacers while the end blocks slide on the end spacers.

* * * * *